US007316121B2

(12) United States Patent
Lee et al.

(10) Patent No.: US 7,316,121 B2
(45) Date of Patent: Jan. 8, 2008

(54) DISPENSER OF ICEMAKER IN REFRIGERATOR

(75) Inventors: Wook Yong Lee, Gwangmyeong-si (KR); Eui Yeop Chung, Seoul (KR); Seung Hwan Oh, Seoul (KR); Myung Ryul Lee, Seongnam-si (KR); Chang Ho Seo, Seoul (KR); Seong Jae Kim, Ansan-si (KR); Sung Hoon Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/833,009

(22) Filed: Apr. 28, 2004

(65) Prior Publication Data

US 2005/0056043 A1 Mar. 17, 2005

(30) Foreign Application Priority Data

Sep. 17, 2003 (KR) ..... 10-2003-0064503

(51) Int. Cl.
*F25C 5/18* (2006.01)

(52) U.S. Cl. ..... 62/344; 222/559

(58) Field of Classification Search ..... 62/344, 62/389–390; 141/174; 222/559, 561, 526, 222/504, 530, 538

See application file for complete search history.

(56) References Cited

U.S. PATENT DOCUMENTS 2,078,097 A 4/1937 Radzinsky
2,126,491 A 8/1938 McCartha
2,462,743 A 2/1949 Handel
2,512,395 A 6/1950 Sundberg
3,429,140 A 2/1969 White
3,476,295 A 11/1969 Telfer
3,747,363 A * 7/1973 Grimm ..... 62/377
3,851,939 A 12/1974 Benasutti et al.
4,209,999 A 7/1980 Falk et al.
4,227,383 A * 10/1980 Horvay ..... 62/344

(Continued)

FOREIGN PATENT DOCUMENTS

EP 0449061 10/1991

(Continued)

OTHER PUBLICATIONS

Japan Office Action with English Translation dated Dec. 19, 2006, Application No. 2001-159282 (4 pages).

*Primary Examiner*—William E. Tapolcai
(74) *Attorney, Agent, or Firm*—Fish & Richardson P.C.

(57) ABSTRACT

Disclosed is a dispenser of an icemaker in a refrigerator for maximizing an inner space when a total size is the same, and for minimizing the total size when the inner space is the same. The dispenser of the icemaker in the refrigerator includes an ice chute being a passage through which the ice produced from the icemaker is discharged; and a container supporter provided at an outer case and disposed to be perpendicular to an outer surface of the outer case when the ice is discharged outside through the ice chute, the contain supporter allowing a container seated thereon to receive the ice discharged from the ice chute. The ice chute is closed and not exposed outside when the ice-discharging process is finished, and the container supporter is not exposed to the outer surface of the outer case.

85 Claims, 15 Drawing Sheets

U.S. PATENT DOCUMENTS

| | | | | | |
|---|---|---|---|---|---|
| 4,252,002 | A | * | 2/1981 | Mullins, Jr. | 62/344 |
| 4,284,212 | A | * | 8/1981 | Caswell | 222/333 |
| 4,739,629 | A | | 4/1988 | True | |
| 5,112,477 | A | | 5/1992 | Hamlin | |
| 5,269,154 | A | | 12/1993 | Schmidt | |
| 5,297,400 | A | | 3/1994 | Benton et al. | |
| 5,490,547 | A | | 2/1996 | Abadi et al. | |
| 5,542,265 | A | * | 8/1996 | Rutland | 62/389 |
| 5,683,015 | A | | 11/1997 | Lee | |
| 5,797,524 | A | | 8/1998 | Lentz | |
| 5,956,967 | A | | 9/1999 | Kim | |
| 6,050,097 | A | | 4/2000 | Nelson et al. | |
| 6,082,130 | A | | 7/2000 | Pastryk et al. | |
| 6,101,835 | A | | 8/2000 | Butsch et al. | |
| 6,135,173 | A | * | 10/2000 | Lee et al. | 141/361 |
| 6,148,624 | A | | 11/2000 | Bishop et al. | |
| 6,286,324 | B1 | | 9/2001 | Pastryk et al. | |
| 6,314,745 | B1 | | 11/2001 | Janke et al. | |
| 6,351,958 | B1 | | 3/2002 | Pastryk et al. | |
| 6,595,021 | B2 | * | 7/2003 | Skinner | 62/344 |
| 6,648,187 | B1 | | 11/2003 | Shypkowski | |
| 6,651,449 | B2 | | 11/2003 | Heims et al. | |
| 6,679,082 | B1 | * | 1/2004 | Tunzi | 62/344 |
| 2001/0030201 | A1 | | 10/2001 | Gerhardt | |

FOREIGN PATENT DOCUMENTS

| | | |
|---|---|---|
| JP | 50-69644 | 6/1975 |
| JP | 51-4116 | 2/1976 |
| JP | 51-021164 | 2/1976 |
| JP | 58-74086 | 10/1989 |
| JP | 2002-115960 | 4/2002 |
| KR | 2001-0005331 | 1/2001 |

* cited by examiner

DISPENSER OF ICEMAKER IN REFRIGERATOR

CROSS-REFERENCE TO RELATED APPLICATIONS

This application claims the benefit of Korean Application No. P2003-64503, filed on Sep. 17, 2003, which is hereby incorporated by reference as if fully set forth herein.

BACKGROUND OF THE INVENTION

1. Field of the Invention

The present invention relates to a dispenser of an icemaker in a refrigerator, and more particularly, to the dispenser of the ice-making apparatus with a structure for maximizing an inner space of the refrigerator.

2. Discussion of the Related Art

In general, a refrigerator is divided into a cooling chamber and a freezer. The cooling chamber keeps a temperature at about 3° C.–4° C. for keeping food and vegetables fresh for a long time. The freezer keeps a temperature at a sub-zero temperature for keeping and storing meat and fish frozen for a long time and for making and storing ice.

The recent refrigerator is developed for performing various additional functions besides a typical function thereof. The icemaker is one of the additional functions.

FIG. 1 illustrates a schematic diagram showing a conventional refrigerator. FIG. 2 illustrates a schematic diagram showing an interior of the refrigerator including a conventional ice-making apparatus. FIG. 3 illustrates a schematic diagram showing an icemaker of a conventional ice-making apparatus. FIG. 4 illustrates a diagram showing a process of discharging the ice from an icemaker. FIG. 5 illustrates an ice bank of an ice-making apparatus in the conventional refrigerator.

Referring to FIG. 1 to FIG. 5, an icemaker 10 is fixed at an upper part of the freezer in the refrigerator. The icemaker 10 is a device for freezing water and automatically discharging ice.

A structure of a conventional icemaker 10 includes an ice-making chamber 11, a water supplier 12 provided at a side of the ice-making chamber 11 for supplying water to the ice-making chamber 11, a controller 13 provided on outside of the ice-making chamber 11 and having a motor (not shown), and an ejector for discharging the ice produced from the ice-making chamber 11.

At a rear side of the ice-making chamber 10, a coupler 15 is provided for coupling the icemaker 10 with the freezer of the refrigerator.

The ice-making chamber 11 is formed in a semi-cylindrical form and having a projection 11*a* therein for dividing the inner space such that the ice is produced in a predetermined size.

The ejector 14 includes an axis formed to cross a center of the ice-making chamber 11 and a plurality of ejector fins 14*a* formed at a side of the axis of the ejector 14. The plurality of ejector fins 14*a* is a means of discharging the produced ice to the ice bank 20.

A sliding bar 16 is provided at a side of the plurality of ejector fins 14*a* for sliding the produced ice down. In more detail, the ice moved by the plurality of ejector fins 14*a* are placed on the sliding bar 16, then slid down along the sliding bar 16, and moved into an inside of an ice bank 20 formed at a lower part of the icemaker.

FIG. 4 illustrates a process of discharging ice from the icemaker 10 to the ice bank 20. A heater 17 is provided at a lower part of the ice-making chamber 11. The ice needs to be separated from a surface of the ice-making chamber for being moved. The heater 17 heats a lower surface of the ice-making chamber 11 and increases a temperature thereof for melting a surface of the ice so as to move the ice.

At a door 1 of the cooling chamber of the refrigerator, the ice bank 20 and a dispenser 30 are provided except the icemaker 10. The ice bank 20 is an apparatus for storing the ice produced from the icemaker 10 and discharging the ice when a user wants the ice to use.

Referring to FIG. 5, the ice bank 20 includes an ice remover 21, a motor 20 for rotating the ice remover, an ice crusher 23, and an ice discharger 24.

The ice remover 21 formed in a spiral form removes the ice supplied from the icemaker 10 to the ice crusher 23 when the motor 22 rotates.

The ice passed through the crusher 23 is discharged to the dispenser 30 through the ice discharger 24. The dispenser 30 includes a discharging passage 31 and a container supporter 35 provided at a lower part of the discharging passage.

The discharging passage 31 includes an inlet provided on an inner wall of the door 1, an outlet provided on an outer wall of the door 1, and a pipe for communicating the inlet with the outlet. In this case, the inlet of the discharging passage is provided at a higher place than the outlet.

The container supporter 35 is provided at a lower part of the discharging passage. In more detail, a vertical plane provided on the outer wall of the door at a lower part of the outlet of the discharging passage 31 includes a groove formed in a quadrilateral form.

A process of discharging the ice from the ice-making apparatus structured as aforementioned will be described as follows.

First, the icemaker being supplied with water through a water supply pipe produces the ice, and removes the ice to the ice bank provided at a lower part of the icemaker by using the ejector.

The ice bank storing the ice discharges the ice outside through the ice-discharging passage when the user wants to use the ice. The ice discharged outside is entered into a container and provided to the user, the container securely provided on the container supporter including the groove formed on the outer wall of the door.

However, the dispenser of the icemaker has following problems. First, the container supporter of the dispenser includes the groove with a predetermined depth on the outer wall of the door of the refrigerator. Accordingly, the door needs to be thicker than a predetermined thickness. The thick door takes up much of an inner space of the refrigerator. Therefore, a total size of the refrigerator is increased when the inner space of the refrigerator is made to be larger than a predetermined size.

Second, an outlet side of the discharging passage of the dispenser is exposed outside and dirt is collected thereon resulting in a problem of polluting the ice discharged outside by the dirt.

SUMMARY OF THE INVENTION

Accordingly, the present invention is directed to a dispenser of an icemaker in a refrigerator that substantially obviates one or more problems due to limitations and disadvantages of the related art.

An object of the present invention is to provide an apparatus having a function of discharging ice with a dispenser of an icemaker for maximizing an inner space of the apparatus.

Another object of the present invention is to provide an apparatus having a function of discharging ice with a dispenser of an icemaker for minimizing a total size of the dispenser.

A further object of the present invention is to provide an apparatus having a function of discharging ice with a dispenser of an icemaker for completely isolating an inside of an outer case from an outside thereof.

Additional advantages, objects, and features of the invention will be set forth in part in the description Which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dispenser of an icemaker of the present invention includes an ice chute provided as a passage through which the ice produced from the icemaker provided inside of an outer case is discharged, and a container supporter provided at the outer case and disposed to be perpendicular to an outer surface of the outer case when the ice is discharged outside through the ice chute, the container supporter allowing a container seated thereon to receive the ice discharged from the ice chute.

The ice chute is closed and not exposed outside when the ice is not discharged. The ice chute includes a first chute having an inlet provided on an inner wall of a front surface of the outer case and a passage extended downward in a wall direction of the outer case, and a sliding member having a second chute diagonally extended, the sliding member moving forward to be perpendicular to the front surface of the outer case for communicating the second chute with the first chute when the ice is discharged, and being inserted into the outer case when the ice is not discharged.

The sliding member further includes a rack provided at a bottom surface thereof; and a pinion provided at a bottom of the rack and mated with the rack.

The dispenser of the icemaker further includes a cover having a first end coupled with a lower end of a front surface of the sliding member, and a second end extended upward and fixed on the front surface of the outer case.

Meanwhile, the ice chute includes an ice-discharging pipe having an inlet provided on an inner surface of the outer case and an outlet provided on an outer surface of the outer case, and a cover provided at the outer case for opening and closing the outlet of the ice-discharging pipe.

In this case, the cover is rotatably provided around a top end being coupled with the front surface of the outer case. The cover also includes a subsidiary pipe provided on a portion being in contact with the outlet portion of the ice-discharging pipe to be inserted into an inside of a passage on the outlet side of the ice discharging pipe.

The subsidiary pipe comprises an ice-passing hole at a lower part thereof for discharging the ice when the cover is rotated upward.

The container supporter is rotated downward to be perpendicular to the front surface of the outer case when the ice is discharged. The container supporter rotates upward and covers the cover.

The dispenser of the icemaker further includes a link member for coupling the container supporter with the cover.

The container supporter is inserted into a wall of the outer case when the ice is not discharged through the ice chute.

The container supporter includes a rack provided at a bottom surface thereof, and a pinion provided under the rack and mated with the rack.

Contrary to the structure mentioned above, the container supporter may be provided under the ice chute and have an end being rotatably coupled with the front surface of the outer case.

The container supporter is rotated downward to be perpendicular to the front surface of the outer case when the ice is discharged. The container supporter closes the ice chute when the ice is not discharged.

The container supporter includes a rotating axis horizontally provided at an end of the outer wall of the outer case, a driven gear provided at the rotating axis, and a driving gear mated with the driven gear.

Owing to the dispenser of the icemaker with aforementioned structure, an inner space of the ice-discharging apparatus such as a refrigerator is maximized or a total size of the apparatus is minimized.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

In general, an icemaker is an apparatus for freezing supplied water in a predetermined size and discharging outside for supplying ice to a user when the user wants to use the ice. The icemaker provides crushed ice or uncrushed ice to the user in accordance with a choice of the user.

In general, a refrigerator is provided with the icemaker, however, may be provided with a drinking apparatus such as a purifier.

Hereinafter, a preferred embodiment of the dispenser discharging and supplying the ice to the user outside will be described referring to FIG. 6 and FIG. 15 in accordance with the icemaker with such function mentioned above.

Figure 1:
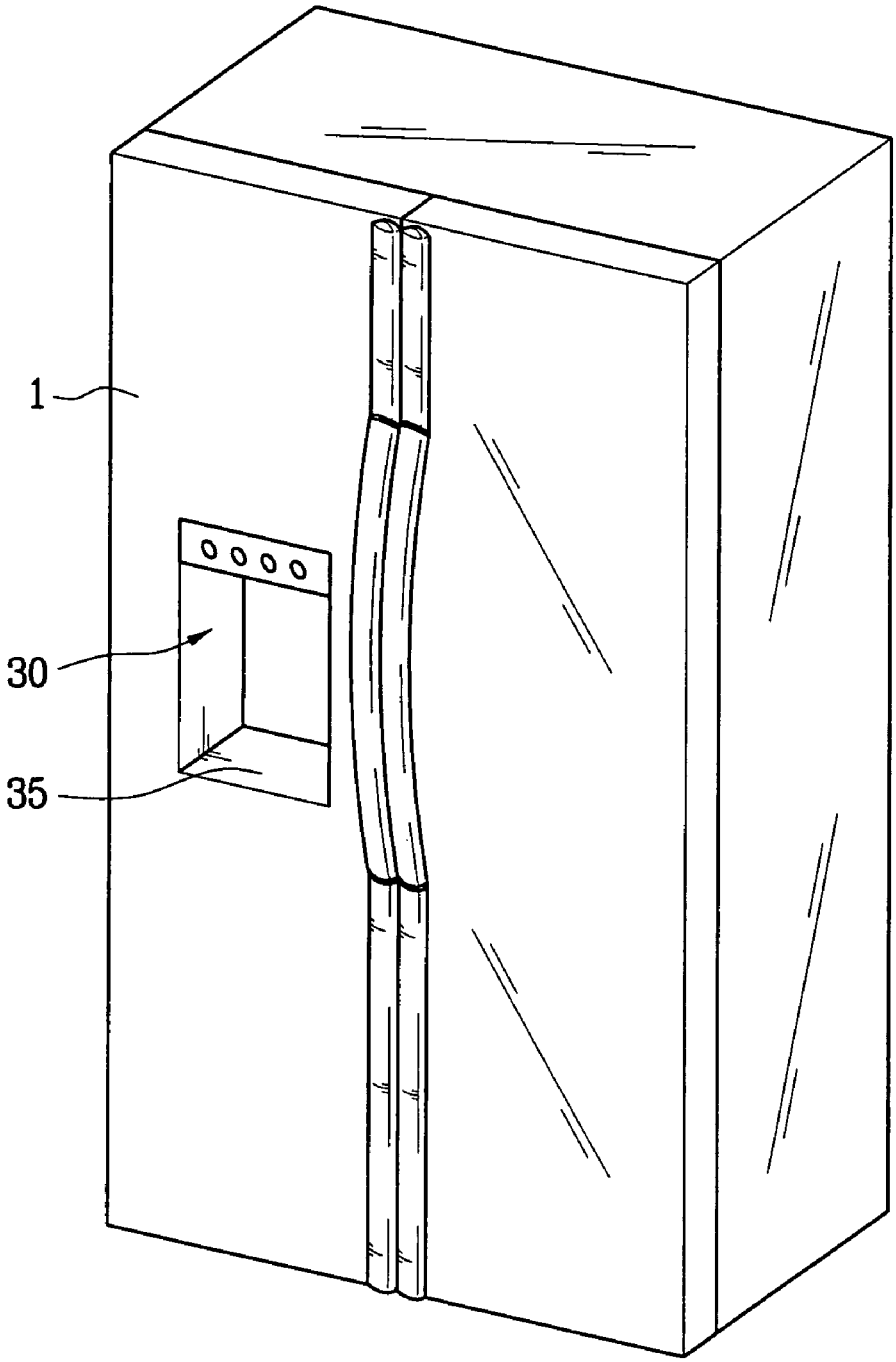
FIG. 1 Prior Art
FIG. 1 illustrates a schematic diagram showing a conventional refrigerator.
Figure 2:
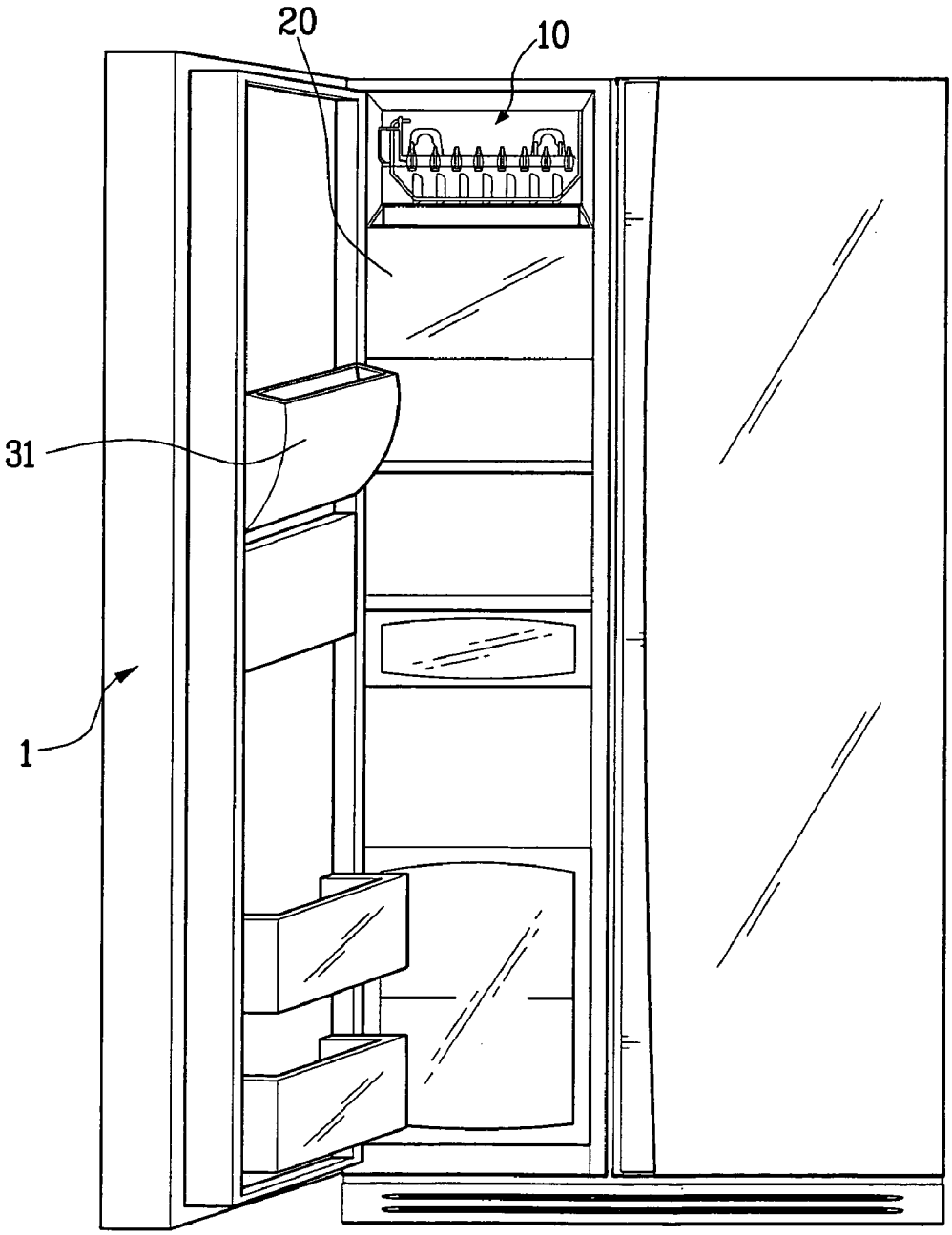
FIG. 2 Prior Art
FIG. 2 illustrates a schematic diagram showing an interior of the refrigerator including a conventional ice-making apparatus.
Figure 3:
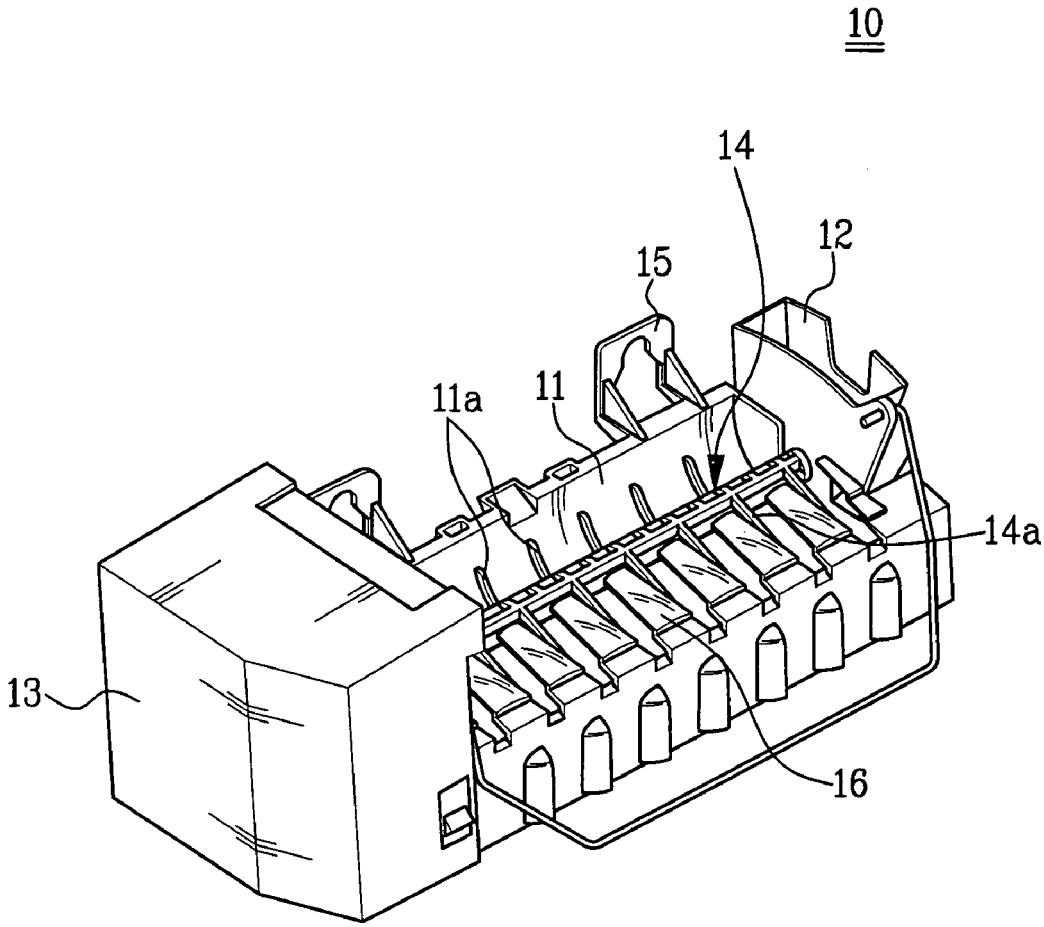
FIG. 3 Prior Art
FIG. 3 illustrates a schematic diagram showing an icemaker of a conventional ice-making apparatus.
Figure 4:
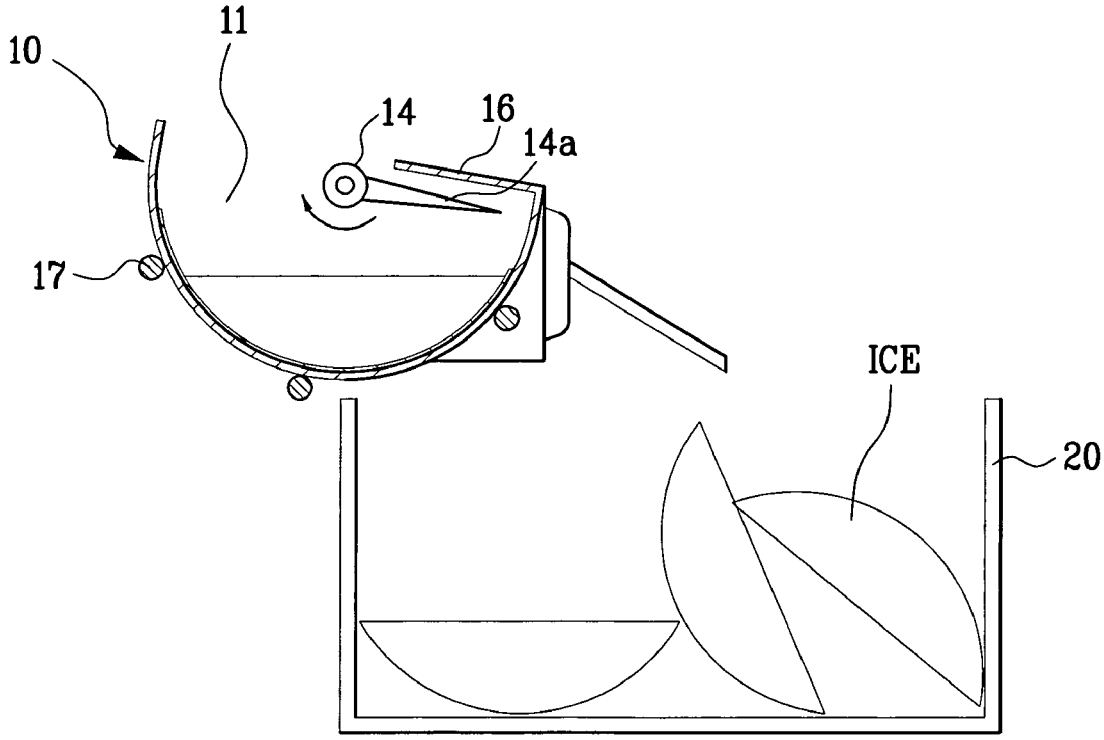
FIG. 4 Prior Art
FIG. 4 illustrates a diagram showing a process of discharging ice from an icemaker.
Figure 5:
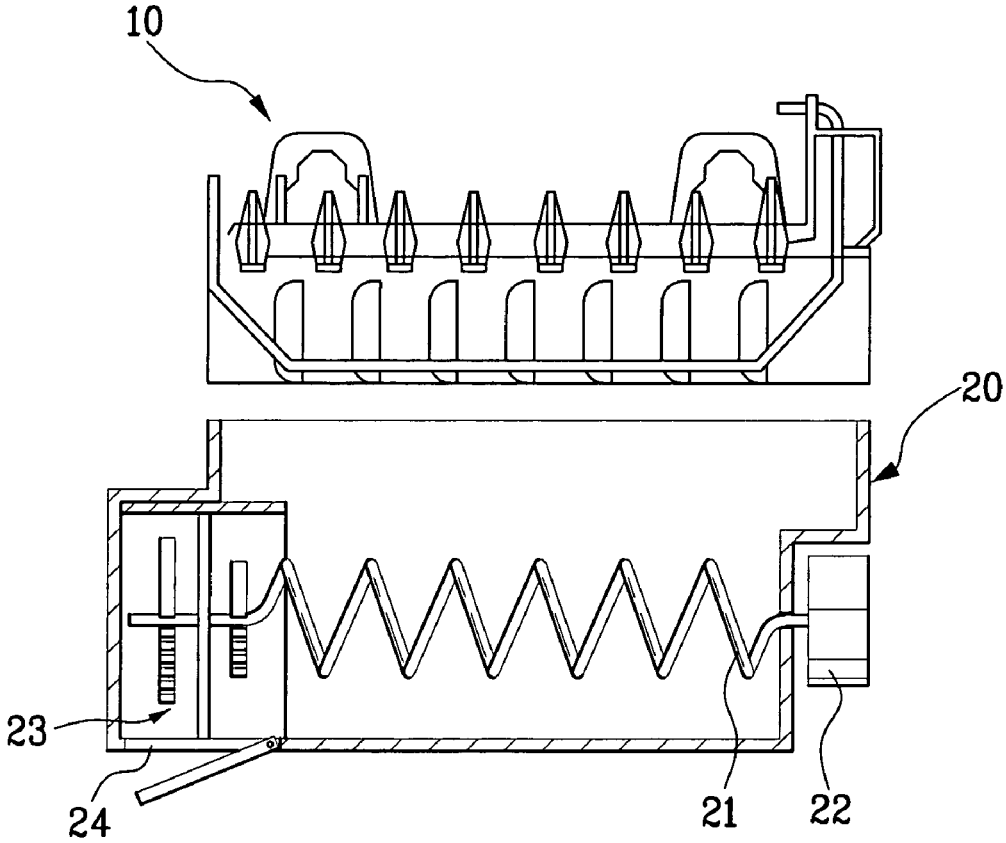
FIG. 5 Prior Art
FIG. 5 illustrates an ice bank of an ice-making apparatus in the conventional refrigerator.
Figure 6:
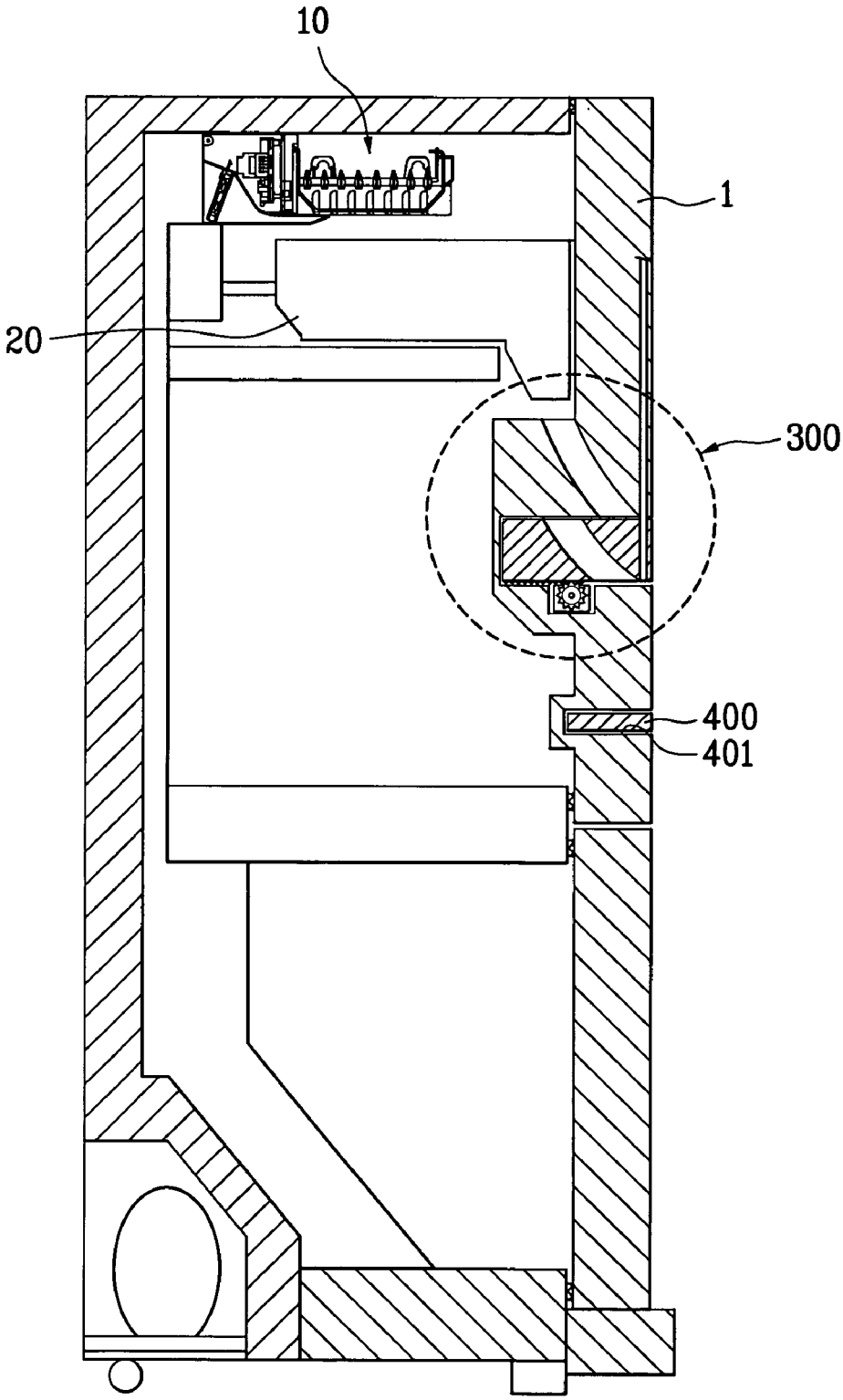
FIG. 6 illustrates a diagram showing a refrigerator with a dispenser of an ice-making apparatus in accordance with a first embodiment of the present invention.
Figure 7:
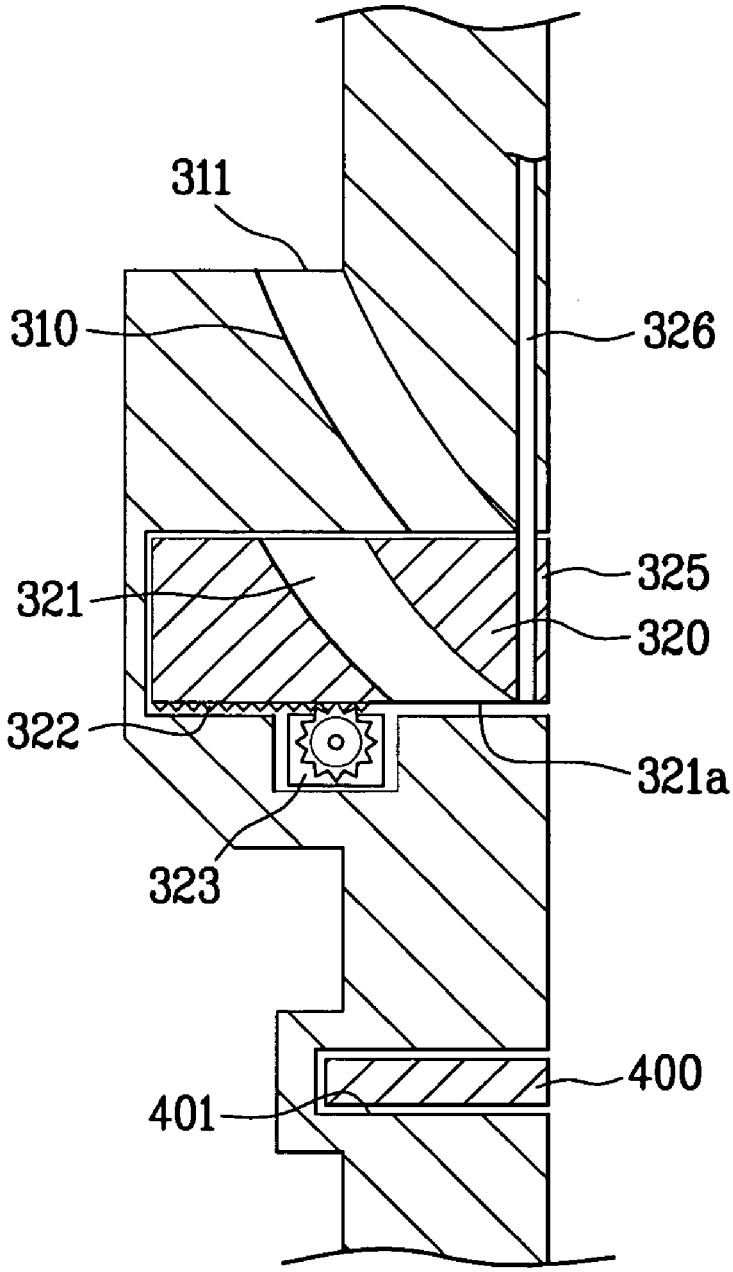
FIG. 7 illustrates a magnified view of a dispenser of an ice-making apparatus in accordance with a first embodiment of the present invention.
Figure 8:
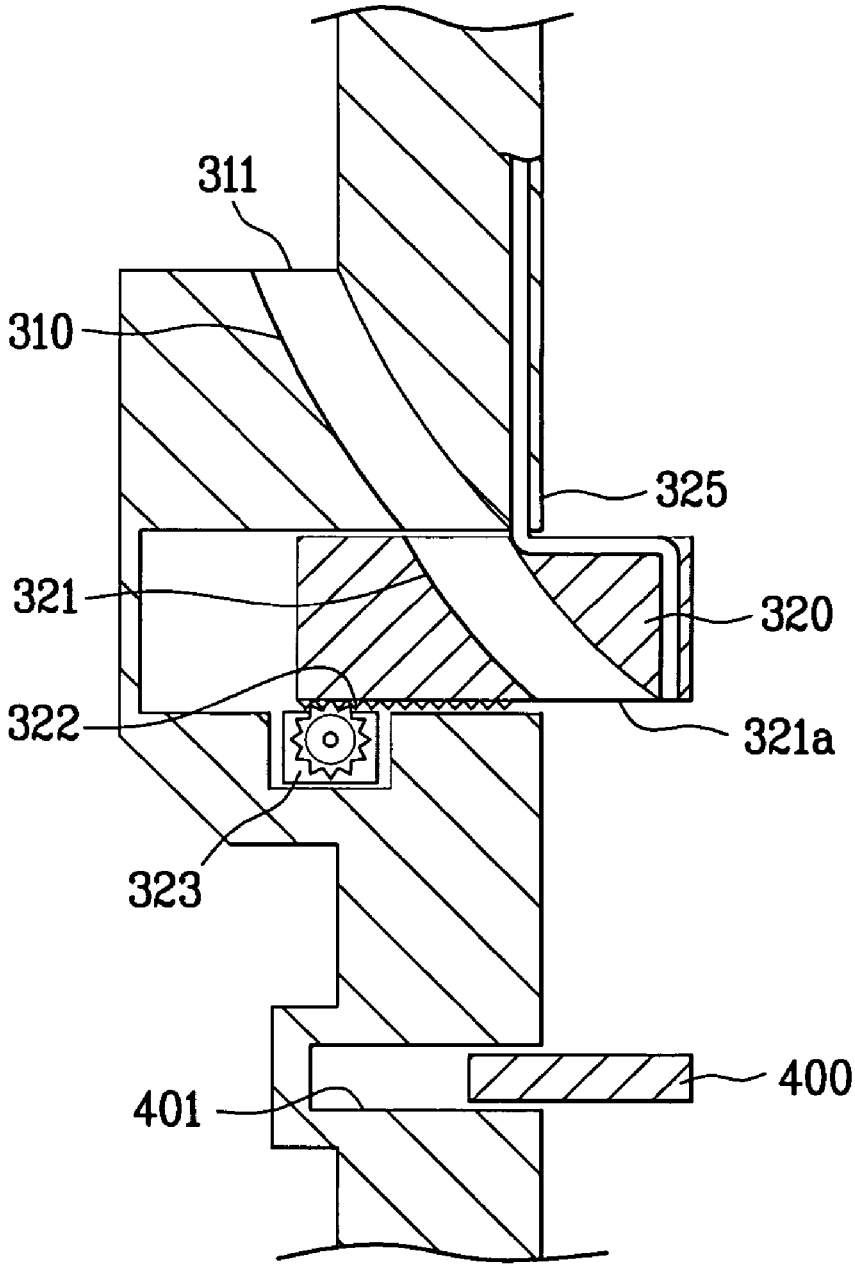
FIG. 8 illustrates a diagram showing a dispenser of an ice-making apparatus in a state of discharging ice accordance with a first embodiment of the present invention.

Referring to FIG. 6 to FIG. 7, a first embodiment of the dispenser of the icemaker in accordance with the present invention includes an ice chute 300 provided at a door and forming a front surface of an outer case of the refrigerator, and a container supporter 400 provided at a lower part of the ice chute 300.

The ice chute 300 is a passage through which the ice produced from the icemaker is discharged. It is desirable that the passage is closed for preventing the ice from being exposed outside when the ice is not discharged.

In other words, the ice chute 300 includes an inlet through which the ice is inserted from a side of the icemaker, and an outlet through which the ice is discharged.

When the ice is not discharged, it is desirable that the outlet is closed for preventing dirt from being collected thereon.

Ice chute 300 includes a first chute 310 having an inlet 311 provided on an inner wall of the door and a passage extended bottomward in a direction of an outer wall of the door, and a sliding member 320 with a second chute 321 communicating with the first chute 310 when the ice is discharged and having an outlet 321*a* exposed outside.

In more detail, the sliding member 320 moves toward the front of the door and projects to be perpendicular to the front surface of the door. In this instance, the second chute 321 is communicated with the first chute 310.

When the ice is not discharged from the ice chute, the sliding member 320 is inserted into a groove formed on the outer surface of the door 1. In this case, it is desirable that the sliding member 320 is not projected toward outside of the door surface and the sliding member includes a guide rail for a smooth movement. The sliding member 320 also includes a handle on a front surface thereof for being manually inserted or ejected.

The dispenser also includes a spring or an oil pressure means (not illustrated) provided between a rear surface of the sliding member 320 and the groove for pressing a rear surface of the container supporter. The dispenser includes a binding for biding the sliding member. When the binding is released, the sliding member is ejected to a front of the door. If a front surface of the sliding member is pressed, the sliding member is inserted into the groove and locked by the biding.

Contrary to the above statement, the sliding member 320 can be automatically inserted and ejected. For this, the sliding member includes a rack 322 provided at a lower surface thereof, and a pinion 323 provided at a lower part of the rack 322. A motor (not illustrated) driven by a controller rotates the pinion 323.

In other words, when the user wants to use the ice and presses an ejection button provided at the controller (not illustrated), the motor rotates the pinion 323 and the rack 322 to, and projects the sliding member 320 by moving the sliding member 320 toward the front. The first chute 310 and the second chute 321 are communicated to discharge the ice. When the process for discharging the ice is finished, the motor is inversely rotated to insert the sliding member 320 into the groove so as to close the ice chute 300.

The dispenser of icemaker with a structure mentioned above, further includes a cover 325 having a first end coupled with a front lower end of the sliding member and a second end fixed on the front surface of the door 1. The cover 325 covers an external appearance of the ice chute 300 as well as prevents dirt from being collected on a top surface of the sliding member.

Is it desirable that a pipe for supplying drinking water is provided between the cover 325 and the door 1 so as to supply water in the container provided at the container supporter 400 when the user wants water or water with the ice.

At the container supporter 400, a container for receiving the discharged ice is provided at a lower part of the ice chute. The container supporter 400 is provided at the door 1 forming the front surface of the outer case, projected vertically above the front surface of the door 1 when the ice is discharged to outside through the ice chute 300.

Contrary to this, when the ice is not discharged, the container supporter is inserted into the groove 401 formed on the door. In this case, it is desirable that the container supporter is not projected to outside of the door and having a guide rail provided at the groove for smoothly moving.

In this case, the container supporter 400 includes a handle (not illustrated) on the front surface thereof so as to be inserted and ejected manually.

The dispenser also includes a spring or an oil pressure means (not illustrated) provided between a rear surface of the sliding member 320 and the groove for pressing the rear surface of the container supporter, and a binding for biding the sliding member. When the binding is released, the sliding member is ejected on the front of the door. If a front surface of the sliding member is pressed, the sliding member is inserted into the groove and locked by the biding.

Contrary to this, the container supporter can be automatically inserted or ejected. For this, the container supporter, as the sliding member, includes the rack provided at the lower surface thereof, and the pinion provided at the lower part of the rack, the pinion rotatably provided For this, the sliding member includes a rack 322 provided on a lower surface thereof, and a pinion provided at a lower part of the rack and mated with the rack so as to rotate together by a motor (not illustrated) driven by a controller.

In other words, when the user wants the ice and presses the ejection button, the motor rotates the pinion and the rack, and the container supporter is moved to the front and projected on the front of the door. When the ice discharging process is finished, the motor is inversely rotated to insert the sliding member 320 into the groove. In the dispenser of the icemaker with the structure mentioned above, it is desirable that the container supporter 410 is ejected earlier than the sliding member 320.

In other words, it is desirable that the ice is discharged after the container supporter is ejected, the container is provided on top of the container supporter, and the sliding member is ejected.

A second embodiment of the dispenser of the icemaker in accordance with the present invention will be described in reference to FIG. 9 to FIG. 10.

Figure 9:
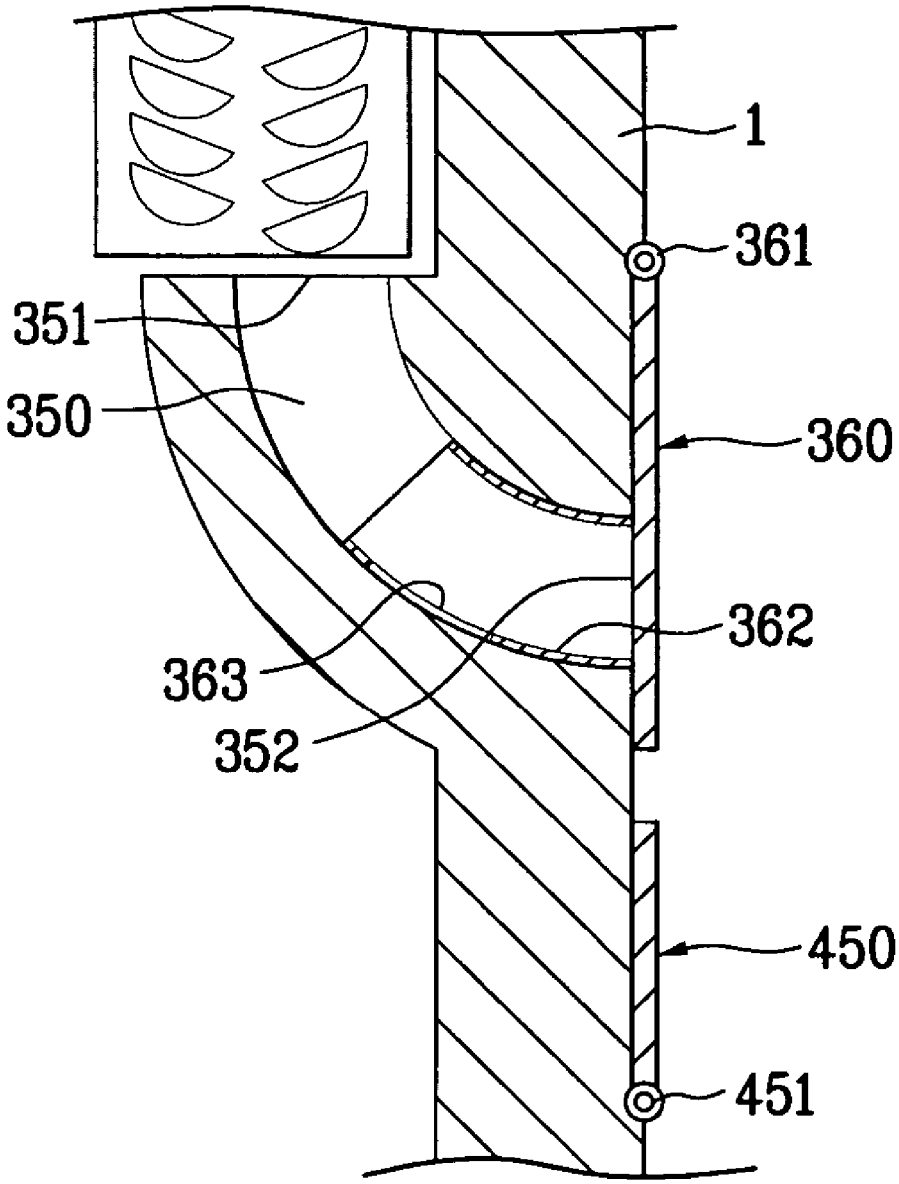
FIG. 9 illustrates a diagram showing a dispenser of an ice-making apparatus in accordance with a second embodiment of the present invention.
Figure 10:
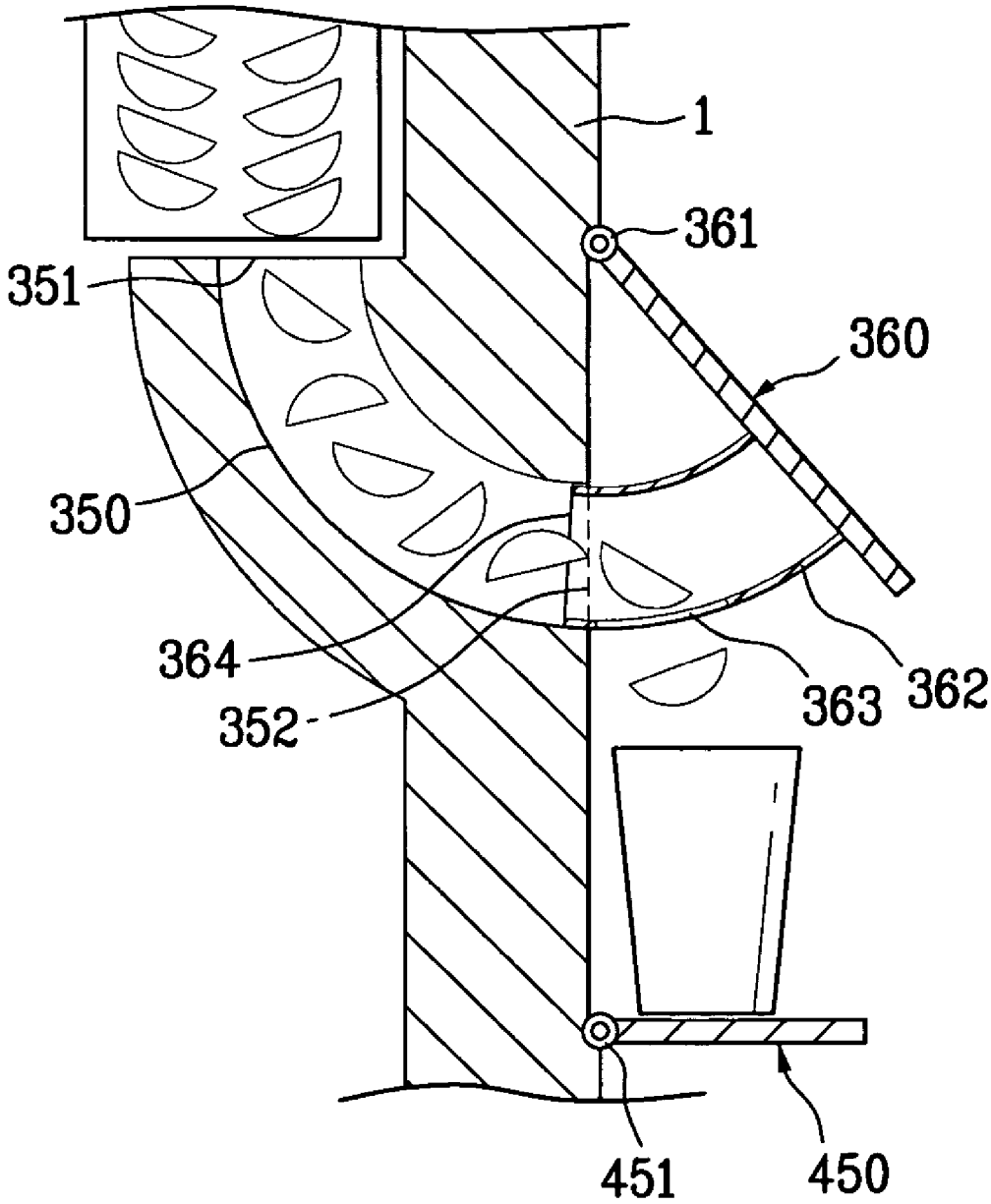
FIG. 10 illustrates a diagram showing a dispenser of an ice-making apparatus in a state of discharging ice accordance with a second embodiment of the present invention.

Referring to FIG. 9, the dispenser of the icemaker includes an ice-discharging pipe, the pipe having an inlet 351 formed on an inner surface of the door 1 of the refrigerator and an outlet 352 formed on an outer surface of the door, a cover 360 provided on the outer surface of the door for opening and closing the outlet 352, and a container supporter 450 having the container securely provided thereon for receiving the ice discharged outside through the ice-discharging pipe.

The inlet 351 is provided at an upper part of the outlet 352 for discharging the ice inserted from the icemaker by gravity. The cover 360 having a top end coupled with the door 1 of the refrigerator is rotatably provided around the top end 361.

The cover 360 also includes a subsidiary pipe 362 provided on the inner surface of the cover in contact with the outlet of the ice-discharging pipe so as to insert the ice into the inside of passage on a side of the outlet 352 of the ice-discharging pipe.

The subsidiary pipe 362 includes an ice-passing hole 363 provided at a lower part thereof in order to discharge the ice when the top cover is rotated upward.

In other words, when the cover 360 is rotated, the ice-passing hole 363 of the subsidiary pipe 362 is exposed to the outside of the ice-discharging pipe 350 and the ice is discharged. In this instance, an end 364 of the subsidiary pipe is not exposed to the outside of the ice-discharging pipe.

Although the user can manually opens and closes the cover 360, the outlet of the ice-discharging pipe is automatically opened and closed in accordance with the second embodiment.

Meanwhile, the container supporter 450 is provided at the lower part of the cover and has an end rotatably coupled with the front surface of the refrigerator.

When the ice is discharged, the container supporter 450 is rotated downward around the lower end 451 to be projected vertically on the front surface of the door 1.

When the ice is not discharged, the container supporter is rotated upward around the lower end 451 to be in contact with the front surface of the door.

Although not illustrated, in the present embodiment, the container supporter and the cover are formed in a semicircular form for an external appearance.

It is desirable that grooves formed in same forms as the cover and the container supporter are provided on the outer wall of the door such that the container supporter and the cover are not projected on the front surface of the door when the ice is not discharged. In the mean time, when the ice is not discharged, it is not the cover but the container supporter directly opening and closing the ice chute.

The container supporter 450 automatically rotates and includes a rotating axis provided horizontally at an end coupled with the outer wall of the outer case, a driven gear provided at the rotating axis, and a driving gear coupled with the driven gear. The structure will be described again in describing a fourth embodiment of the present invention.

The motor operated by the controller (not illustrated) rotates the driving gear. The rotating method is applicable to a rotation of the cover 360.

Contrary to the above statement, a portion 1*a* located at an inside of the cover on the outer wall of the door and the cover 360 are formed as a single body, and the top portion of the subsidiary pipe 362 includes the portion 1*a* on the outer wall of the door, the portion 1*a* integrated with the cover 360.

Figure 11:
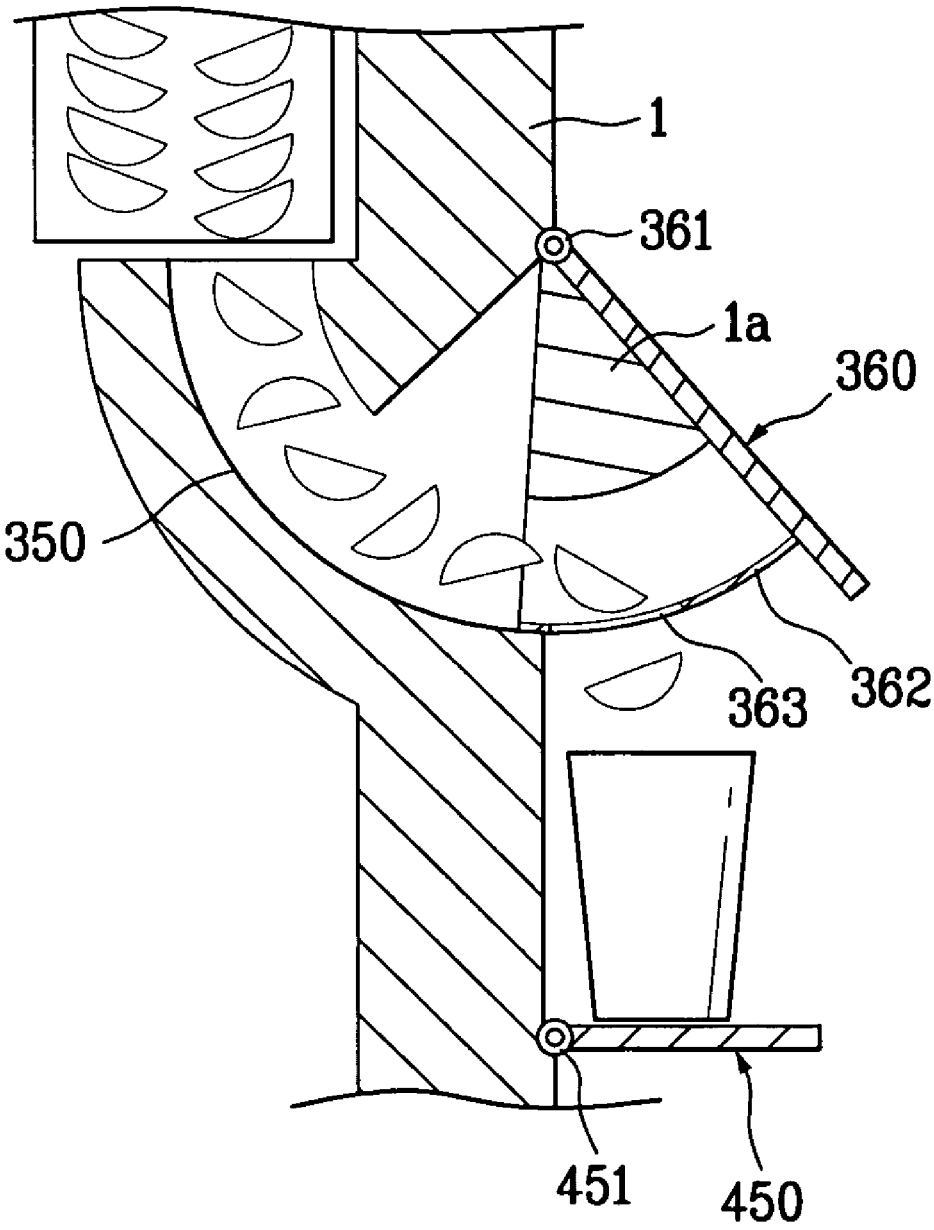
FIG. 11 illustrates a diagram showing a dispenser of an ice-making apparatus in a state of discharging ice accordance with a third embodiment of the present invention.

The dispenser of the icemaker with the structure mentioned above is a third embodiment illustrated in FIG. 11. In accordance with the third embodiment of the present invention, the other components except the structure of the third embodiment is the same as the second embodiment and it will be omitted.

Figure 12:
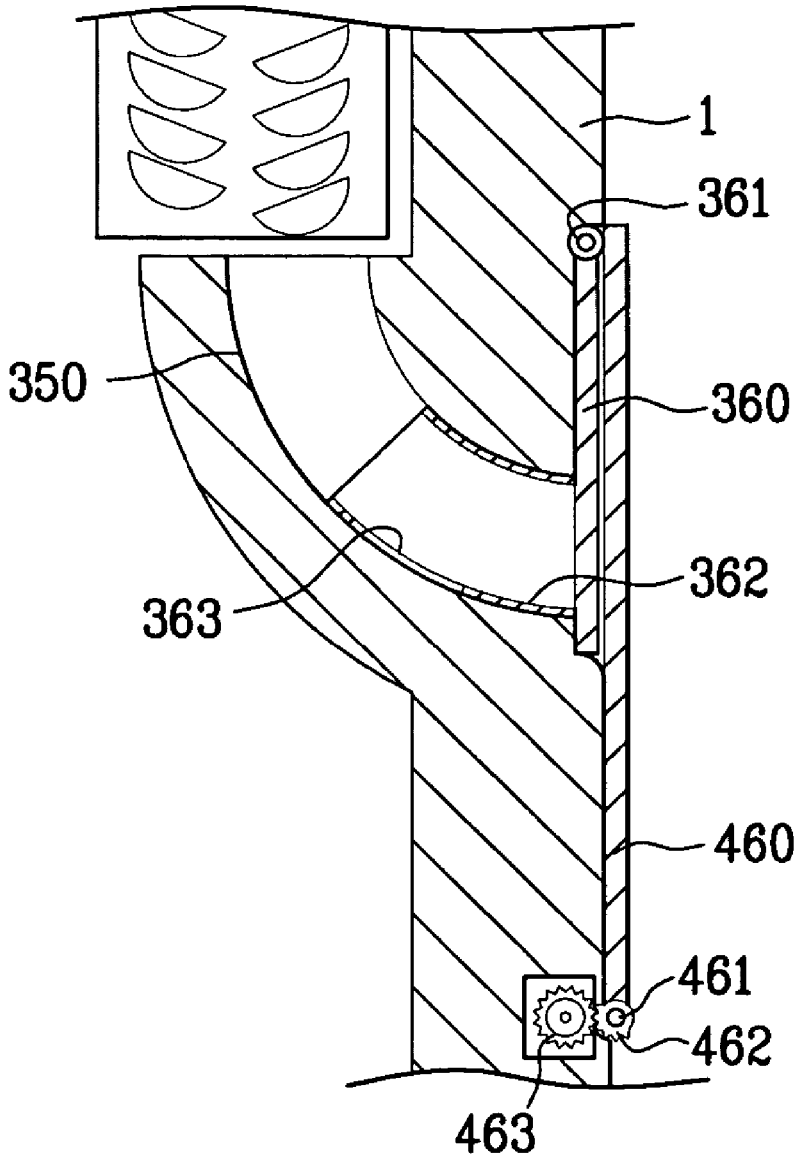
FIG. 12 illustrates a diagram showing a dispenser of an ice-making apparatus in accordance with a fourth embodiment of the present invention.
Figure 13:
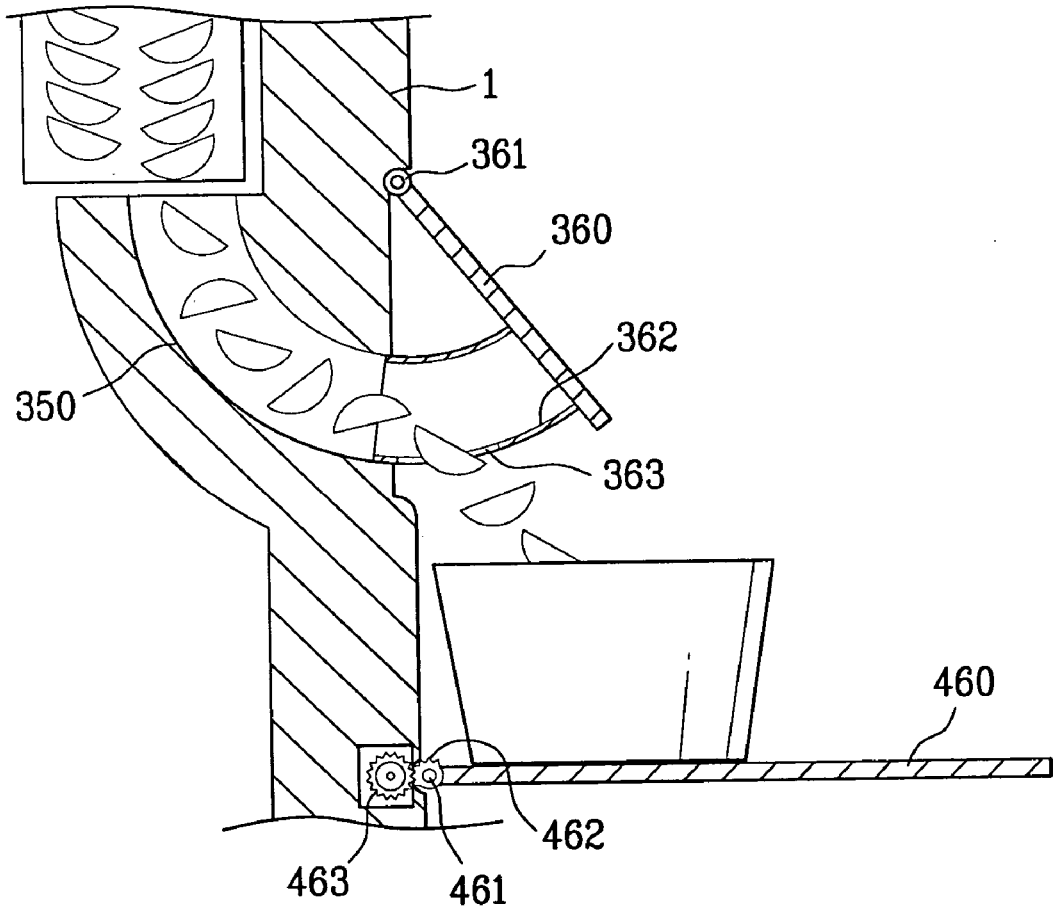
FIG. 13 illustrates a diagram showing a dispenser of an ice-making apparatus in a state of discharging ice accordance with a fourth embodiment of the present invention.
Figure 14A:
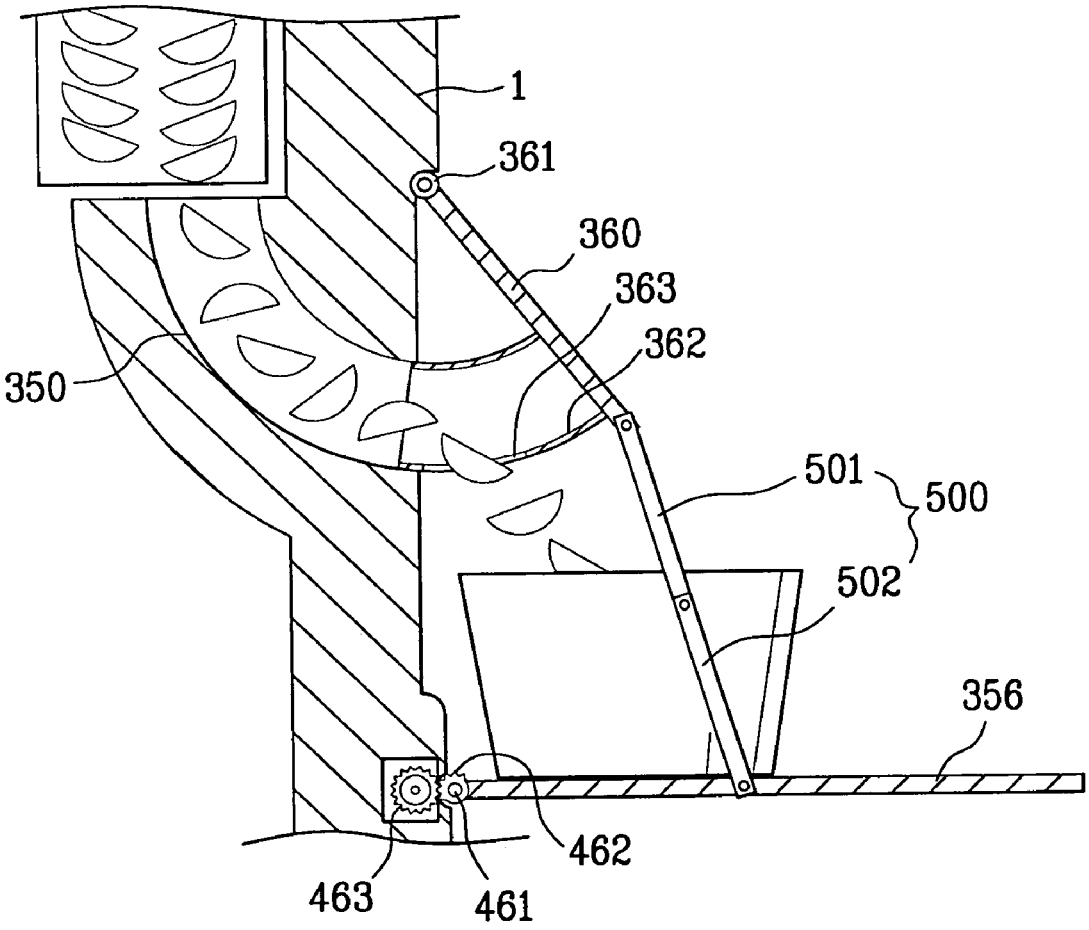
FIGS. 14A and 14B illustrate a diagram showing a coupling material in accordance with a fourth embodiment of the present invention.
Figure 14B:
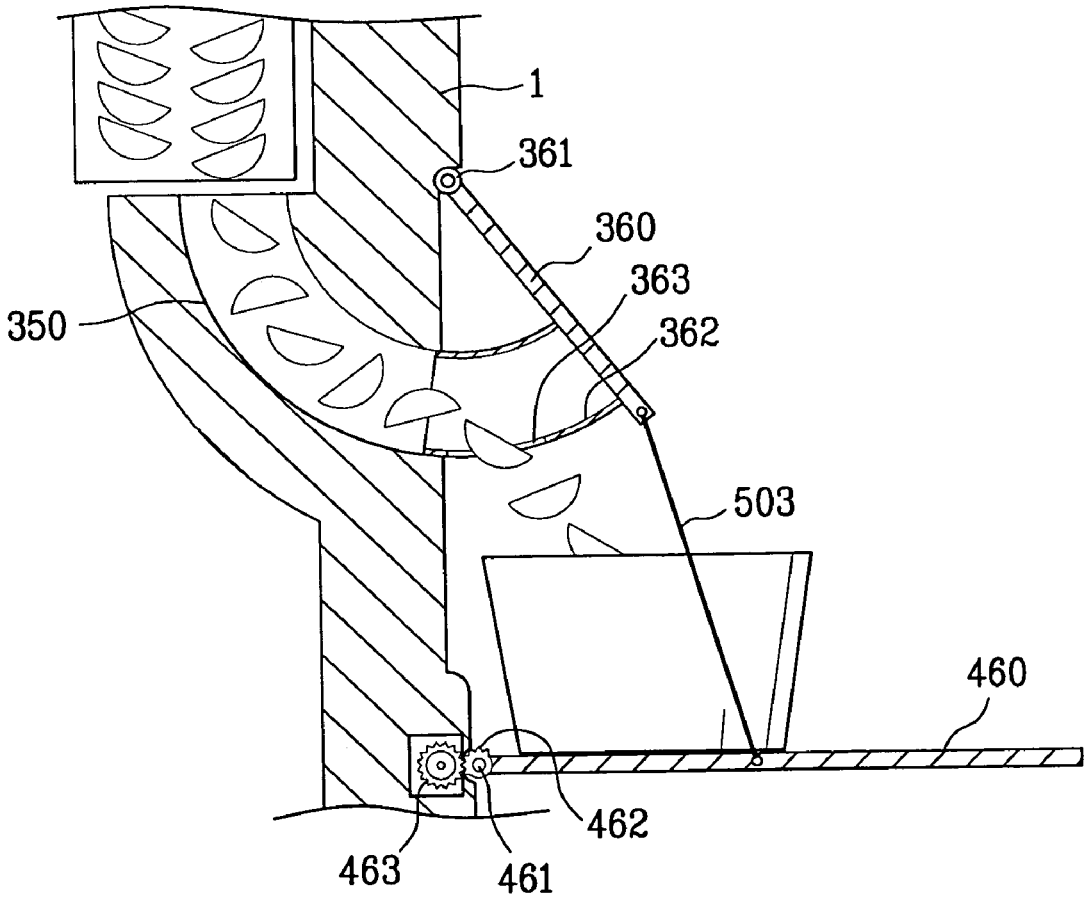

Meanwhile, the container supporter 460 covers the cover 360 as illustrated in FIG. 12 to FIG. 14. The structure mentioned above is a fourth embodiment. In accordance with the present invention, all other compositions except the components explained below are the same as the second and the third embodiments.

In accordance with the present invention, as illustrated in FIG. 14, the dispenser of the icemaker includes a link member 500 coupling the container supporter 460 and the cover 360.

The link member 500 has a first end coupled with the lower side of the cover 360 and a second end coupled with a side of the container supporter 460. For this, the link member includes a top coupler 501 rotatably coupled with the lower side of the cover, and a bottom coupler 502 having a first end rotatably coupled with a second end of the top coupler and a second end rotatably coupled with the lower side of the container supporter.

Contrary to the above statement, the link member 500 may include a soft string 503. The link member 500 becomes parallel to the cover for supporting weight of the container supporter having the container when the container supporter is rotated downward to be perpendicular to the outer wall of the outer case for discharging the ice.

The container supporter 460 is automatically rotated. For this, the container supporter 460 includes a rotating axis 461 provided horizontally at an end coupled with the outer wall of the outer case, a driven gear 462 provided at the rotating axis, and a driving gear 463 mated with the driven gear for driving the driven gear.

The dispenser of the icemaker with the structure mentioned above is operated as follows. First, when the user wants the ice and presses the ejection button of the controller, the container supporters (400, 450, 460) are provided to be perpendicular to the front surface of the door of the refrigerator.

For this, the container supporter 400 in the first embodiment of the present invention is withdrawn to the front surface of the door by the rotation of the pinion and the container supporters 450 and 460 in the second and fourth embodiments are rotated downward by the driving gear to be perpendicular to the front surface of the door.

Next, when the ice chute 300 and 350 are opened, the ice is discharged outside and received into the container provided on top of the container supporter. Then, the user takes the ice to put in a beverage or in food. The opening process of the ice chute is described above and a detailed description will be omitted.

When the ice is discharged as much as the user needs, the container supporter is inserted into the inside of the groove provided at the door or is rotated upward by the driving gear, and adhered to the front surface of the door to be horizontal thereto in accordance with the present embodiment. Then, the container supporter or the cover closes the outlet of the ice chute.

Effects of the present invention with above mentioned structure is summarized as follows. First, a space taken by the container supporter or the ice chute is minimized and an inner space of the refrigerator or an apparatus with an ice-discharging function is maximized in accordance with the present invention.

Second, the space taken by the container supporter of the ice chute is minimized and the total size of the refrigerator or the apparatus with an ice-discharging function is minimized in accordance with the present invention.

Third, the outlet of the ice chute provided on the ice discharging passage is completely closed when the ice is not discharged in order to prevent the dirt from being collected on the passage in accordance with the present invention.

Fourth, the external appearance is improved because the ice chute and the container supporter are not projected outside or caved-in in accordance with the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dispenser for an appliance comprising:

a water dispensing assembly comprising a chute through which water is discharged; and a container support provided at an outer casing and configured to be perpendicular to an outer surface of the outer casing when water is discharged through the chute, the container support being configured to allow a container received thereon to receive water discharged through the chute, wherein the container support is retractable into a wall of the outer casing.

2. The dispenser of claim 1, wherein the container support comprises:

a rack provided at a bottom surface of the container support; and a pinion provided beneath the rack and engaged with the rack.

3. The dispenser of claim 2 further comprising a motor configured to rotate the pinion to move the container support by engagement of the rack and pinion.

4. The dispenser of claim 1 wherein the container support and at least a portion of the water dispensing assembly are configured for coordinated movement between advanced and retracted positions.

5. The dispenser of claim 1 further comprising a motor configured to move the container support.

6. The dispenser of claim 1 wherein the water dispensing assembly is configured to dispense liquid.

7. The dispenser of claim 1 wherein the water dispensing assembly is configured to dispense ice.

8. The dispenser of claim 1 wherein the water dispensing assembly is configured to dispense liquid and ice simultaneously.

9. The dispenser of claim 1 wherein the water dispensing assembly is configured to dispense water irrespective of a position of the container support.

10. A dispenser for an appliance comprising:

a water dispensing assembly configured to move, such that an outlet of the water dispensing assembly is positioned outside an outer surface of a door of an appliance in at least one position of water dispensing assembly movement; and a container support configured to extend along a plane perpendicular to the door such that the container support is configured for movement between a withdrawn and an extended position, the container support being configured to, in the extended position, support a container being filled by the water dispensing assembly when the outlet of the water dispensing assembly is positioned outside an outer surface of the door.

11. The dispenser of claim 10 further comprising:

a first mechanical drive mechanism configured to move the water dispensing assembly; and a second mechanical drive mechanism configured to extend the container support along a plane perpendicular to the door between the withdrawn and extended positions, wherein the second mechanical drive mechanism is configured to extend the container support along a plane perpendicular to the door prior to the first mechanical drive mechanism moving the water dispensing assembly to a position at which the outlet of the water dispensing assembly is positioned outside an outer surface of the door.

12. The dispenser of claim 11 wherein the first mechanical drive mechanism and the second mechanical drive mechanism are activated by a single input device.

13. The dispenser of claim 10 wherein the movement of the water dispensing assembly is independent from the movement of the container support.

14. The dispenser of claim 10 further comprising a mechanical drive mechanism configured to extend the container support along a plane perpendicular to the door between the withdrawn and extended positions.

15. The dispenser of claim 14 wherein the mechanical drive mechanism includes a spring.

16. The dispenser of claim 14 wherein the mechanical drive mechanism includes an oil pressure assembly.

17. The dispenser of claim 14 wherein the mechanical drive mechanism includes a motor.

18. The dispenser of claim 17 wherein the container support includes a rack and the motor is configured to rotate a pinion mated with the rack.

19. The dispenser of claim 14 wherein the mechanical drive mechanism is configured to retract the container support along a plane perpendicular to the door between the withdrawn and extended positions.

20. The dispenser of claim 10 further comprising a mechanical drive mechanism configured to move the water dispensing assembly.

21. The dispenser of claim 20 wherein the mechanical drive mechanism includes a spring.

22. The dispenser of claim 20 wherein the mechanical drive mechanism includes an oil pressure assembly.

23. The dispenser of claim 20 wherein the mechanical drive mechanism includes a motor.

24. The dispenser of claim 23 wherein the water dispensing assembly includes a rack and the motor is configured to rotate a pinion mated with the rack.

25. The dispenser of claim 10 wherein the outlet of the water dispensing assembly is not exposed when the outlet of the water dispensing assembly is positioned inside an outer surface of the door.

26. The dispenser of claim 10 wherein the water dispensing assembly is configured to dispense liquid.

27. The dispenser of claim 10 wherein the water dispensing assembly is configured to dispense ice.

28. The dispenser of claim 10 wherein the water dispensing assembly includes a sliding member and an end portion of a water supply pipe attached to the sliding member.

29. The dispenser of claim 28 wherein the water supply pipe extends when the outlet of the water dispensing assembly is positioned outside an outer surface of the door.

30. The dispenser of claim 10 wherein the water dispensing assembly includes a sliding member and an ice chute.

31. The dispenser of claim 30 wherein the ice chute communicates with a second ice chute extending from an icemaker when the outlet of the water dispensing assembly is positioned outside an outer surface of the door, the second ice chute and the icemaker remaining inside the outer surface of the door.

32. The dispenser of claim 10 wherein the outlet of the water dispensing assembly includes an outlet of a water supply pipe.

33. The dispenser of claim 10 wherein the outlet of the water dispensing assembly includes an outlet of an ice chute.

34. The dispenser of claim 10 wherein the water dispensing assembly is configured to move about a plane perpendicular to the door of the appliance.

35. The dispenser of claim 10 wherein the water dispensing assembly is configured to dispense liquid and ice simultaneously.

36. A dispenser for an appliance comprising:

a movable member;

a water supply mechanism attached to the movable member; and a mechanical drive mechanism configured to, upon activation of a user control, apply force other than supplied by a user to motivate movement of the movable member from a first position at which an outlet of the water supply mechanism is positioned behind a plane representing an outer surface of a door of an appliance to a second position at which the outlet of the water supply mechanism is positioned in front of the plane representing the outer surface of the door.

37. The dispenser of claim 36 wherein the mechanical drive mechanism includes a spring.

38. The dispenser of claim 36 wherein the mechanical drive mechanism includes an oil pressure assembly.

39. The dispenser of claim 36 wherein the mechanical drive mechanism includes a motor.

40. The dispenser of claim 39 wherein the movable member includes a rack and the motor is configured to rotate a pinion mated with the rack.

41. The dispenser of claim 36 further comprising a container support configured to extend along a plane perpendicular to the door.

42. The dispenser of claim 41 wherein the container support in an extended position is configured to support a container being filled when the movable member is in the second position.

43. The dispenser of claim 36 wherein the water supply mechanism is configured to dispense liquid.

44. The dispenser of claim 36 wherein the water the water supply mechanism is configured to dispense ice.

45. The dispenser of claim 36 wherein the water supply mechanism is configured to dispense liquid and ice simultaneously.

46. The dispenser of claim 36 wherein the outlet of the water supply mechanism includes an outlet of a water supply pipe.

47. The dispenser of claim 36 wherein the outlet of the water supply mechanism includes an outlet of an ice chute.

48. The dispenser of claim 36 wherein the mechanical drive mechanism is configured to apply force to the movable member to motivate movement of the movable member about a plane perpendicular to the door of the appliance.

49. A dispenser for an appliance comprising:

a water dispensing assembly;

first moving means for moving the water dispensing assembly between a position at which an outlet of the water dispensing assembly is positioned outside an outer surface of a door of an appliance and at least one another position;

a container support; and second moving means for moving the container support along a plane perpendicular to the door between a withdrawn and an extended position, the container support configured to support a container being filled by the water dispensing assembly when the first moving means moves the water dispensing assembly to the position at which the outlet of the water dispensing assembly is positioned outside the outer surface of the door of the appliance and the second moving means moves the container support to the extended position.

50. The dispenser of claim 49 wherein the second moving means moves the container support to the extended position prior to the first moving means moving the water dispensing assembly to the position at which the outlet of the water dispensing assembly is positioned outside the outer surface of the door of the appliance.

51. The dispenser of claim 49 further comprises a single user input for activating the first moving means and the second moving means.

52. The dispenser of claim 49 wherein the movement of the first moving means is independent from the movement of the second moving means.

53. The dispenser of claim 49 wherein the water dispensing assembly dispenses liquid.

54. The dispenser of claim 49 wherein the water dispensing assembly dispenses ice.

55. The dispenser of claim 49 wherein the water dispensing assembly dispenses liquid and ice simultaneously.

56. The dispenser of claim 49 wherein the first moving means moves the water dispensing assembly about a plane perpendicular to the door of the appliance.

57. A dispenser for an appliance comprising:

a movable member;

a water supply mechanism attached to the movable member; and a user input for enabling activation of the user input, applying a force to motivate movement of the movable member from a first position at which an outlet of the water supply mechanism is positioned behind a plane representing an outer surface of a door of an appliance to a second position at which the outlet of the water supply mechanism is positioned in front of the plane representing the outer surface of the door, the force applied by the positioning means being other than the force input by the user to the user input.

58. The dispenser of claim 57 further comprising a container support.

59. The dispenser of claim 58 further comprising means for moving the container support along a plane perpendicular to the door.

60. The dispenser of claim 59 wherein the container support supports a container being filled when the movable member is moved by the positioning means to the second position.

61. The dispenser of claim 57 wherein the water supply mechanism dispenses liquid.

62. The dispenser of claim 57 wherein the water supply mechanism dispenses ice.

63. The dispenser of claim 57 wherein the water supply mechanism dispenses liquid and ice simultaneously.

64. The dispenser of claim 57 wherein the positioning means applies force to motivate movement of the movable member about a plane perpendicular to the door of the appliance.

65. A method of filling a container with water using a dispenser of an appliance, the method comprising:

extending a container support along a plane perpendicular to a door of an appliance from a withdrawn position to an extended position;

placing a container on the container support when the container support is in the extended position;

moving a water dispensing assembly to a position at which an outlet of the water dispensing assembly is outside of an outer surface of the door of the appliance; and enabling the water dispensing assembly to dispense water into the container.

66. The method of filling a container of claim 65 wherein extending a container support along a plane perpendicular to a door of an appliance from a withdrawn position to an extended position includes manually moving the container support along the plane perpendicular to the door of the appliance from the withdrawn position to the extended position.

67. The method of filling a container of claim 65 wherein extending a container support along a plane perpendicular to a door of an appliance from a withdrawn position to an extended position includes activating an input device to cause a mechanical drive mechanism to move the container support along the plane perpendicular to the door of the appliance from the withdrawn position to the extended position.

68. The method of filling a container of claim 67 wherein by activating the input device to cause the mechanical drive mechanism to move the container support, a force is generated in excess of a force applied by a user.

69. The method of filling a container of claim 65 wherein moving a water dispensing assembly includes manually moving the water dispensing assembly.

70. The method of filling a container of claim 65 wherein moving a water dispensing assembly includes activating an input device to cause a mechanical drive mechanism to move the water dispensing assembly.

71. The method of filling a container of claim 70 wherein by activating the input device to cause the mechanical drive mechanism to move the water dispensing assembly, a force is generated in excess of a force applied by a user.

72. The method of filling a container of claim 65 wherein extending a container support along a plane perpendicular to a door of an appliance from a withdrawn position to an extended position and moving a water dispensing assembly include activating a single input device to cause a first mechanical drive mechanism to move the container support and a second mechanical drive mechanism to move the water dispensing assembly.

73. The method of filling a container of claim 72 wherein the first mechanical drive mechanism is configured to move the container support prior to the second mechanical drive mechanism moving the water dispensing assembly.

74. The method of filling a container of claim 65 wherein enabling the water dispensing assembly to dispense water into the container includes enabling the water dispensing assembly to dispense liquid into the container.

75. The method of filling a container of claim 65 wherein enabling the water dispensing assembly to dispense water into the container includes enabling the water dispensing assembly to dispense ice into the container.

76. The method of filling a container of claim 65 wherein enabling the water dispensing assembly to dispense water into the container includes enabling the water dispensing assembly to dispense liquid and ice into the container simultaneously.

77. The method of filling a container of claim 65 wherein extending a container support along a plane perpendicular to a door of an appliance from a withdrawn position to an extended position is performed before moving a water dispensing assembly to a position at which an outlet of the water dispensing assembly is outside of an outer surface of the door of the appliance.

78. The method of filling a container of claim 65 wherein extending a container support along a plane perpendicular to a door of an appliance from a withdrawn position to an extended position is performed after moving a water dispensing assembly to a position at which an outlet of the water dispensing assembly is outside of an outer surface of the door of the appliance.

79. The method of filling a container of claim 65 wherein placing a container on the container support when the container support is in the extended position is performed before moving a water dispensing assembly to a position at which an outlet of the water dispensing assembly is outside of an outer surface of the door of the appliance.

80. The method of filling a container of claim 65 wherein placing a container on the container support when the container support is in the extended position is performed after moving a water dispensing assembly to a position at which an outlet of the water dispensing assembly is outside of an outer surface of the door of the appliance.

81. The method of filling a container of claim 65 further comprising retracting the container support along the plane perpendicular to the door of the appliance from the extended position to the withdrawn position.

82. The method of filling a container of claim 65 further comprising moving the water dispensing assembly to a position at which an outlet of the water dispensing assembly is inside of the outer surface of the door of the appliance.

83. A method of manufacturing a dispenser for an appliance, the method comprising:

attaining a water dispensing assembly;

configuring the water dispenser assembly with an outlet that is positioned outside of an outer surface of a door of an appliance and that is movable between at least two water dispensing positions;

attaining a container support; and configuring the container support to extend along a plane perpendicular to the door such that the container support is configured for movement between a withdrawn and an extended position, the container support being configured to, in the extended position, support a container being filled by the water dispensing assembly when the outlet of the water dispensing assembly is positioned outside an outer surface of the door.

84. A method of manufacturing a dispenser for an appliance, the method comprising:

attaining a movable member;

attaining a water supply mechanism;

attaching the water supply mechanism to the movable member;

attaining a mechanical drive mechanism;

attaining a user control; and configuring the mechanical drive mechanism to, upon activation of the user control, apply a force other than supplied by a user to motivate movement of the movable member from a first position at which an outlet of the water supply mechanism is positioned behind a plane representing an outer surface of a door of an appliance to a second position at which the outlet of the water supply mechanism is positioned in front of the plane representing the outer surface of the door.

85. The method of manufacturing a dispenser for an appliance of claim 84 wherein the mechanical drive mechanism applies a force greater than a force imparted by a user activating the user control.

* * * * *